US006910290B1

(12) United States Patent
Meurer

(10) Patent No.: US 6,910,290 B1
(45) Date of Patent: Jun. 28, 2005

(54) EXCAVATOR BUCKET WITH RETRACTABLE SCARIFIER AND IMPROVED ACTUATOR MOUNTING

(76) Inventor: Robert Meurer, 15286 93rd Ave., Chippewa Falls, WI (US) 54729

( * ) Notice: Subject to any disclaimer, the term of this patent is extended or adjusted under 35 U.S.C. 154(b) by 0 days.

(21) Appl. No.: 10/805,325

(22) Filed: Mar. 22, 2004

(51) Int. Cl.[7] ..... E02F 3/96
(52) U.S. Cl. ..... 37/405; 37/903
(58) Field of Search ..... 37/430, 403–405, 37/408–410, 443, 444, 903; 414/722; 172/815; 299/25

(56) References Cited

U.S. PATENT DOCUMENTS

| | | | | |
|---|---|---|---|---|
| 2,840,931 A | | 7/1958 | Appel | |
| 3,795,070 A | * | 3/1974 | Bronson et al. | 37/405 |
| 4,038,766 A | | 8/1977 | Felstet | |
| 4,041,624 A | | 8/1977 | Fryrear | |
| 4,056,205 A | | 11/1977 | Etzler, IV | |
| 4,279,085 A | | 7/1981 | Arnold | |
| 4,512,090 A | | 4/1985 | Billings | |
| 4,595,240 A | | 6/1986 | Pettersson | |
| 4,909,333 A | * | 3/1990 | Lindstrom | 172/40 |
| 4,967,850 A | | 11/1990 | Bargfrede et al. | |
| 5,564,885 A | | 10/1996 | Staben, Jr. | |
| 6,098,320 A | * | 8/2000 | Wass | 37/406 |
| 6,434,863 B1 | | 8/2002 | Meurer | |
| 6,490,815 B1 | * | 12/2002 | Pratt | 37/408 |
| 6,546,650 B1 | * | 4/2003 | Meurer | 37/405 |
| 6,572,324 B2 | * | 6/2003 | Ihm | 414/723 |

* cited by examiner

*Primary Examiner*—Robert E. Pezzuto
*Assistant Examiner*—Alicia Torres
(74) *Attorney, Agent, or Firm*—Manelli Denison & Selter; Edward J. Stemberger

(57) ABSTRACT

A device providing a combined bucket and scarifier includes a bucket having a bottom wall, a rear wall, and two side walls coupled to the bottom wall and the rear wall to define an interior space. The bucket has an open front end and the rear wall is generally rectangular having a long axis. A scarifier is operatively associated with the bucket. The scarifier has a plurality of teeth constructed and arranged to be moved with respect to the bucket between a stored, inoperative position, and an operative position with portions of the teeth extending outwardly with respect to a portion of the bottom wall of the bucket. Actuating structure is mounted with respect to the bucket. The actuating structure includes a cylinder unit having a piston, and linkages coupled between the piston and teeth such that movement of the piston causes movement of the linkages thereby causing movement of the teeth between the inoperative and operative positions. The cylinder unit is mounted with respect to the rear wall such that the piston extends generally along the long axis of the rear wall.

11 Claims, 4 Drawing Sheets

EXCAVATOR BUCKET WITH RETRACTABLE SCARIFIER AND IMPROVED ACTUATOR MOUNTING

FIELD OF THE INVENTION

This invention relates to excavator buckets, more specifically, to an excavator bucket including a retractable scarifier useful in breaking-up and leveling ground when attached to a powered device such as skid steer loader or the like.

BACKGROUND OF THE INVENTION

All-wheel drive skid-steer loaders have gained in popularity due to their compact size and maneuverability. The conventional skid-steer loaders are configured so that a variety of separate attachments can be coupled thereto such as an excavator bucket, a scarifier, a dozer blade, etc.

Oftentimes when using a skid-steer loader with a bucket attachment, it is necessary to break-up hard ground. Thus, an operator is required to stop the operation of the loader and physically remove the bucket to put on a scarifier having teeth to break-up compacted or hard ground. Many operators find this to be a great loss in work time and often choose to just break-up the ground with the bucket, thus creating additional costs and loss of time to repair/replace the misused equipment.

There are conventional buckets having teeth that protrude from the lower front edge of the bucket. These buckets work well when digging and ground-breaking are needed but, because the teeth are permanently fixed to the front edge of the bucket, the teeth hinder the process of smoothing and packing soil because the points of the teeth leave lines in the ground during back-dragging of the bucket.

My U.S. Pat. No. 6,546,650 discloses a bucket including a retractable scarifier so that the bucket can be used without obstruction from the scarifier when the scarifier is not required, and so that the scarifier can be employed when needed to break-up hard ground. A hydraulic cylinder or actuator is mounted generally vertically with respect to the rear wall of the bucket to cause movement of the scarifier teeth. Although these type of bucket/scarifiers are effecting in operation, it has been determined that bucket/scarifiers with the vertically mounted cylinder may not be employed on certain skid steers having oversized tires since the cylinder may interfere with the tires.

There is a need to provide a bucket having a retractable scarifier with an improved actuator mounting so that the bucket can be used on any type of powered device without obstructing components of the device.

SUMMARY OF THE INVENTION

An object of the invention is to fulfill the need referred to above. In accordance with the principles of the present invention, this objective is obtained by providing a combined bucket and scarifier device including a bucket having a bottom wall, a rear wall, and two side walls coupled to the bottom wall and the rear wall to define an interior space. The bucket has an open front end and the rear wall is generally rectangular having a long axis. A scarifier is operatively associated with the bucket. The scarifier has a plurality of teeth constructed and arranged to be moved with respect to the bucket between a stored, inoperative position, and an operative position with portions of the teeth extending outwardly with respect to a portion of the bottom wall of the bucket. Actuating structure is mounted with respect to the bucket. The actuating structure includes a cylinder unit having a piston, and linkages coupled between the piston and teeth such that movement of the piston causes movement of the linkages thereby causing movement of the teeth between the inoperative and operative positions. The cylinder unit is mounted with respect to the rear wall such that the piston extends generally along the long axis of the rear wall.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE PREFERRED EXEMPLARY EMBODIMENT

Figure 1:
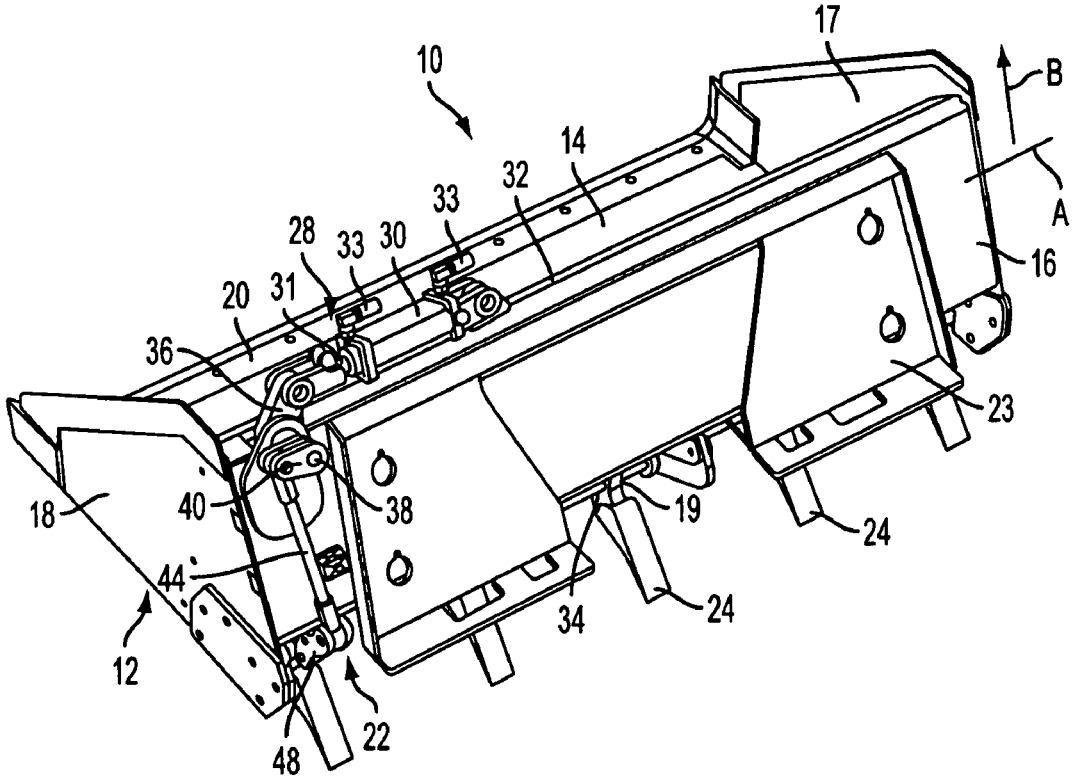
FIG. 1 is rear perspective view of a device providing a combined bucket and scarifier in accordance with the principles of the present invention, shown with a piston of a cylinder unit retracted and thus scarifier teeth in an extended, operative position.
Figure 2:
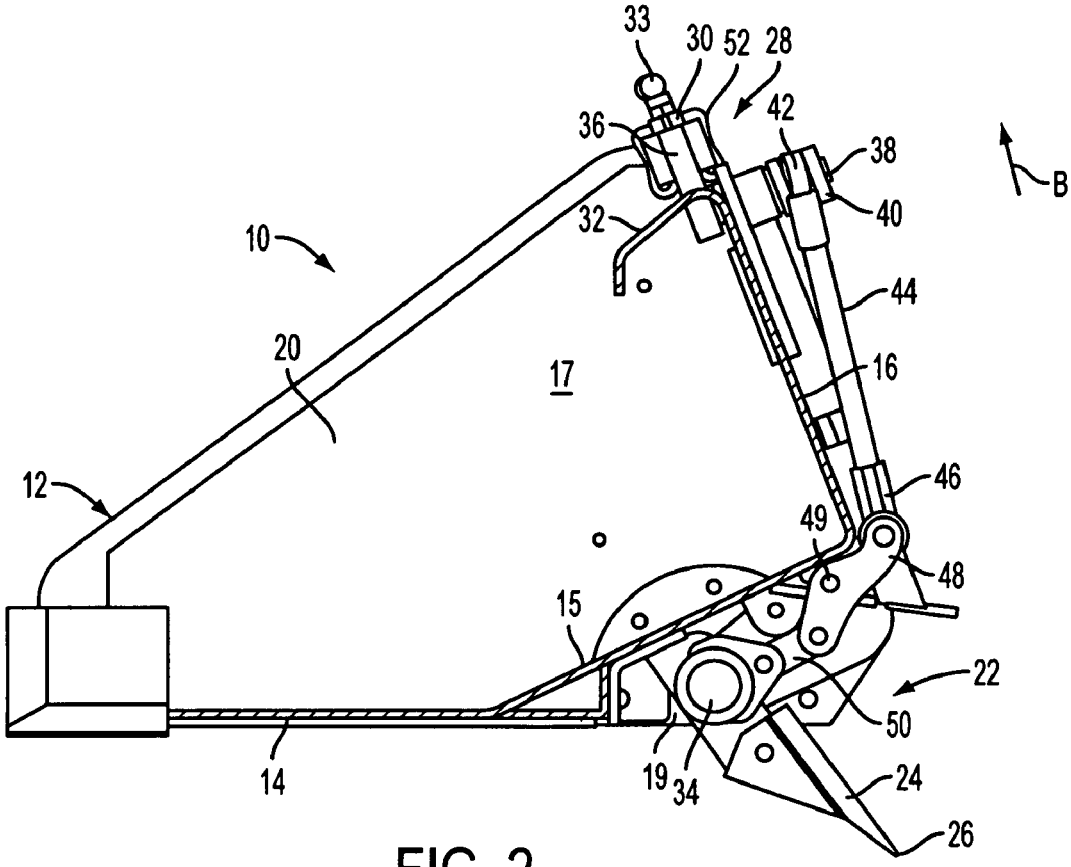
FIG. 2 is a side view, partially in section, of the apparatus of FIG. 1 shown.

With reference to FIGS. 1 and 2, a device providing a combined bucket and scarifier in accordance with the invention is shown generally indicated at 10. The device 10 is constructed and arranged to be attached to, for example, a conventional skid-steer loader such as the type manufactured by the Melroe Company under the name Bobcat®. The device 10 can be employed on any suitable powered device such as skid steers having driving tracks or wheels, or compact utility loaders, such as, for example, the Toro® Dingo.

The device 10 includes a bucket, generally indicated at 12, for use in loading trucks, smoothing the ground by back dragging, etc. The bucket 12 has a bottom wall including a generally planar horizontal portion 14 and a portion 15 extending upwardly at an angle with respect to the planar portion 14, a rear wall 16, a left side wall 17 and a right side wall 18 coupled to the bottom wall 14 and the rear wall 16 to define an interior space 20 for containing soil or the like. The rear wall 16 is generally rectangular defining a long axis A. The bucket 12 has open front end for access to the interior space 20. The angled portion 15 of the bottom wall defines a space 19 at the underside of the bucket for containing a scarifier, generally indicated at 22, as will be explained in more detail below. Mounting structure 23 is coupled to the rear wall 16 for removably coupling the device 10 to a loader such as a conventional compact utility loader or skid-steer loader. The mounting structure 23 can be integral with the rear wall 16 or attached thereto.

The scarifier 22 is operatively associated with the bucket 12. The scarifier 22 includes a plurality of teeth 24 constructed and arranged to be movable with respect to the bucket 12 between a retracted, inoperative position (FIGS. 3 and 4) substantially within space 19 so as not to obstruct the bottom wall portion 14 of the bucket 12, and an extended, operative position (FIGS. 1 and 2). In the operative position, at least a portion of the teeth 24 extend outwardly from the space 19 beyond an extent of the bottom wall portion 14. As shown in FIG. 2, in the operative position thereof, the teeth 24 extend at an angle with respect to the wall portion 14 such that distal ends 26 of the teeth face rearward so that to use the teeth 28 in a ripping operation, the bucket 12 must be dragged backwardly.

The device 10 includes an actuating structure, generally indicated at 28, mounted with respect to the bucket 12 and constructed and arranged to rotate the teeth 24 simultaneously to move the teeth between the inoperative and operative positions. In the embodiment, the actuating structure 28 includes at least one hydraulic cylinder unit 30 and linkages associated with the teeth 24 for moving the teeth 24. In accordance with the invention, cylinder unit 30 is mounted so that a piston 31 thereof extends generally along the long axis A of the rear wall 16 so as not to create an obstruction at the rear of the device 10. In the illustrated embodiment, the cylinder unit 30 is mounted to a top edge 32 of the rear wall 16. The cylinder unit 30 is constructed and arranged to be fluidly coupled to the hydraulics of the conventional device to which it is attached (e.g., loader) via connectors 33.

The teeth 24 are coupled to a common rotatable shaft 34. The linkages include a first linkage 36 pivotally coupled at one end thereof to the piston 31. A transfer linkage or shaft 38 is coupled to the first linkage 36. A second linkage 40 is pivotally coupled to the transfer linkage 38. One end 42 of a third linkage, in the form of a rod 44, is pivotally coupled to the second linkage 42 and the other end 46 of the rod 44 is pivotally coupled to a rocker linkage 48 that pivots about pin 49. The rocker linkage 48 is pivotally coupled to a fourth linkage 50 that is pivotally coupled with a portion of the common rotatable shaft 34.

Thus, with reference to FIGS. 1 and 2, when the piston 31 is retracted into the cylinder unit 30, the first and second linkages 36 and 40, respectively, rotate causing the rod 44 to move generally upwardly (in the direction of arrow B) causing rocker linkage 48 and linkage 50 to rotate, which in turn rotates the common rotatable shaft 34 causing the teeth 24 to rotate to the extended, operative position.

Figure 3:
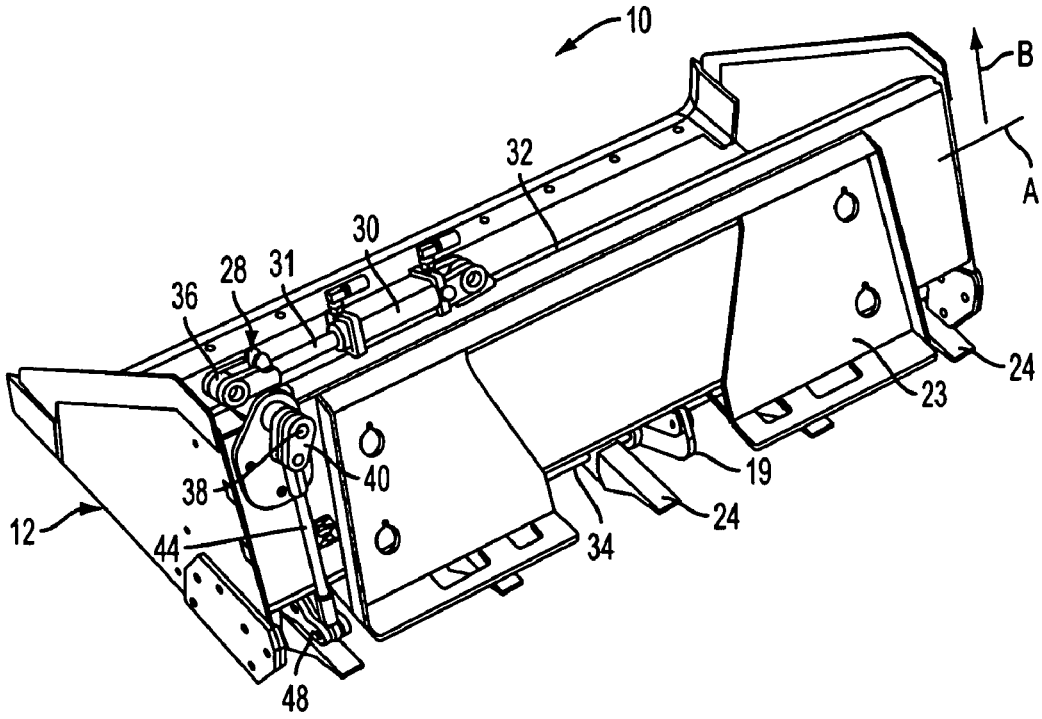
FIG. 3 is rear perspective view of a device providing a combined bucket and scarifier in accordance with the principles of the present invention, shown with the piston of a cylinder unit extended and thus scarifier teeth in a retracted, inoperative position.
Figure 4:
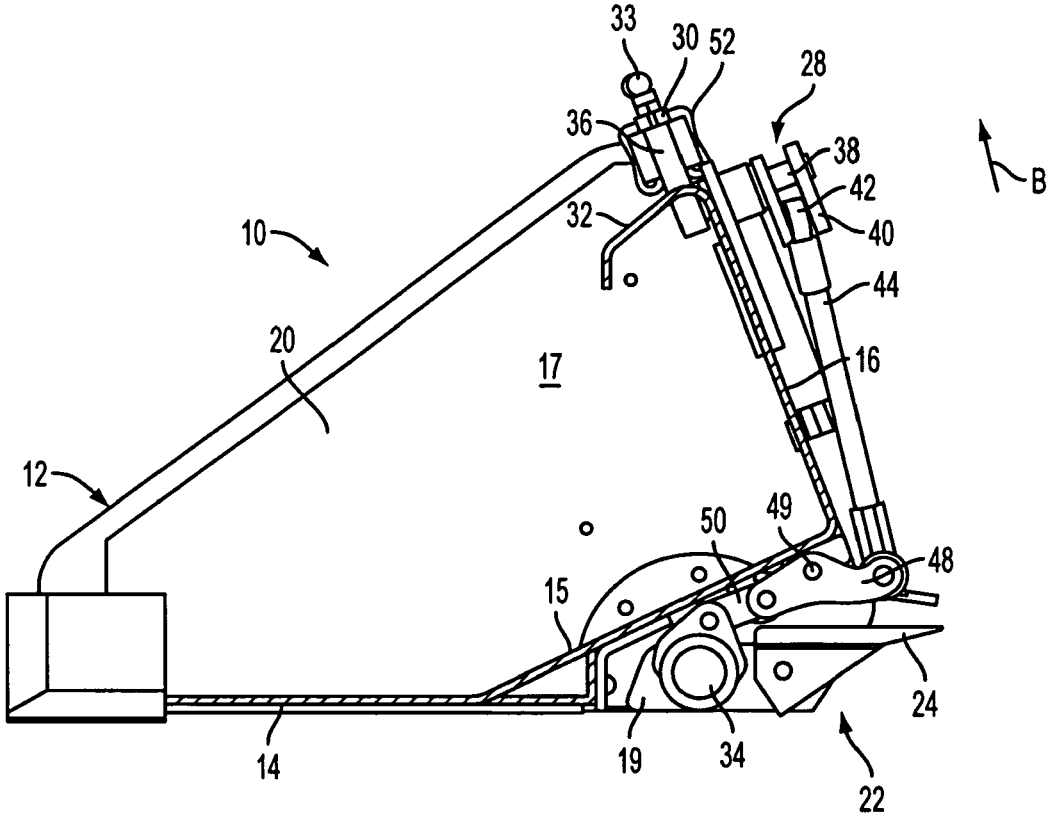
FIG. 4 is a side view, partially in section, of the apparatus of FIG. 3.

With reference to FIGS. 3 and 4, to retract the teeth, 24, the piston 31 is extended from the cylinder unit 30 causing the first and second linkages 36 and 40, respectively, to rotate causing the rod 44 to move generally downwardly (in the direction opposite of arrow B) causing rocker linkage 48 and linkage 50 to rotate, which in turn rotates the common rotatable shaft causing the teeth 24 to rotate to the retracted, inoperative position.

Although one cylinder unit 30 and associated linkages are shown, it can be appreciated that a hydraulic cylinder unit and linkages can be provided near each end of the bucket 12 and operated by a common hydraulic line of the vehicle to which the bucket is attached.

The cylinder unit 30 and thus retraction and extension of the teeth 24 is controlled by a lever of the device to which it is attached (e.g., utility loader, skid-steer loader) that controls the application of hydraulic fluid to the hydraulic cylinder unit(s) 30. When the teeth 24 are not in use, they are retracted or stored so as not to interfere with the normal use of the bucket 12. When the teeth 24 are needed to break-up the hard, packed ground, the operator would only need to operate the lever to lower the teeth 24. The depth of engagement of the teeth 24 with the ground is limited by the underside of the bucket (bottom wall 14).

Thus, with the cylinder unit 30 being mounted generally horizontally with respect to the bucket 12 so that a side 52 thereof is substantially flush with the rear wall 16, the cylinder unit 30 advantageously does not become an obstruction at the rear of the bucket. The linkages between the piston 31 of the cylinder unit 30 ensure transfer of linear, generally horizontal movement of the piston, to rotational movement of the common rotatable shaft that carries the teeth 24. Although particular linkages are illustrated, any linkages can be provided that transfer the linear motion of the piston 31 to rotational movement of the teeth 24.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A device providing a combined bucket and scarifier comprising:

a bucket having a bottom wall, a rear wall, and two side walls coupled to the bottom wall and the rear wall to define an interior space, the bucket having an open front end and the rear wall being generally rectangular having a long axis, a scarifier operatively associated with the bucket, the scarifier having a plurality of teeth constructed and arranged to be moved with respect to the bucket between a stored, inoperative position, and an operative position with portions of the teeth extending outwardly with respect to a portion of the bottom wall of the bucket, and actuating structure mounted with respect to the bucket, the actuating structure including at least one cylinder unit having a piston, and linkages coupled between the piston and teeth such that movement of the piston causes movement of the linkages thereby causing movement of the teeth between the inoperative and operative positions, the cylinder unit being mounted with respect to the rear wall such that the piston extends generally along the long axis of the rear wall, wherein the teeth are coupled to a common rotatable shaft, the linkages being constructed and arranged to transfer generally horizontal linear motion of the piston to generally vertical linear motion and then to rotational motion to rotate the common rotatable shaft.

2. The device of claim 1, wherein the rear wall includes a top edge, the cylinder unit being mounted to the top edge.

3. The device of claim 1, wherein in the operative position thereof, the teeth extend at an angle with respect to the bottom wall such that distal ends of the teeth face rearward.

4. The device of claim 1, wherein the actuating structure is constructed and arranged to rotate the teeth simultaneously to move the teeth between the inoperative and operative positions.

5. The device of claim 1, wherein the piston is constructed and arranged such that when the piston is extended, the teeth are in the inoperative position and when the piston is retracted, the teeth are in the operative position.

6. The device of claim 1, wherein the cylinder unit is constructed and arranged to be hydraulically operated.

7. The device of claim 1, wherein a side of the cylinder unit is substantially flush with the rear wall.

8. The device of claim 1, wherein mounting structure is provided on the rear wall, the mounting structure being constructed and arranged to removably coupled the device to a loader.

9. A device providing a combined bucket and scarifier comprising:

a bucket having a bottom wall, a rear wall, and two side walls coupled to the bottom wall and the rear wall to define an interior space, the bucket having an open front end and the rear wall being generally rectangular having a long axis, a scarifier operatively associated with the bucket, the scarifier having a plurality of teeth constructed and arranged to be moved with respect to the bucket between a stored, inoperative position, and an operative position with portions of the teeth extending outwardly with respect to a portion of the bottom wall of the bucket, and actuating structure mounted with respect to the bucket, the actuating structure including at least one cylinder unit having a piston, and linkages coupled between the piston and teeth such that movement of the piston causes movement of the linkages thereby causing movement of the teeth between the inoperative and operative positions, the cylinder unit being mounted with respect to the rear wall such that the piston extends generally along the long axis of the rear wall, wherein the teeth are coupled to a common rotatable shaft, the linkages include a first linkage pivotally coupled at one end thereof to the piston, a transfer linkage coupled to the first linkage, a second linkage pivotally coupled to the transfer linkage, a third linkage pivotally coupled to the second linkage at one end with another other end of the third linkage being pivotally coupled to a rocker linkage, the rocker linkage being pivotally coupled to a fourth linkage that is pivotally coupled with a portion of the common rotatable shaft.

10. The device of claim 9, wherein the piston and linkages are constructed and arranged such that when the piston is extended, the teeth are in the inoperative position and when the piston is retracted, the teeth are in the operative position.

11. A device providing a combined bucket and scarifier comprising:

a bucket having a bottom wall, a rear wall, and two side walls coupled to the bottom wall and the rear wall to define an interior space, the bucket having an open front end and the rear wall being generally rectangular having a long axis, a scarifier operatively associated with the bucket, the scarifier having a plurality of teeth constructed and arranged to be moved with respect to the bucket between a stored, inoperative position, and an operative position with portions of the teeth extending outwardly with respect to a portion of the bottom wall of the bucket, and actuating structure mounted with respect to the bucket, the actuating structure including at least one cylinder unit having a piston, and linkages coupled between the piston and teeth such that movement of the piston causes movement of the linkages thereby causing movement of the teeth between the inoperative and operative positions, the cylinder unit being mounted with respect to the rear wall such that the piston extends generally along the long axis of the rear wall, wherein the bottom wall includes a generally planar portion and a portion extending upwardly at an angle with respect to the planar portion defining a space at bottom of the bucket, at least a portion of the teeth being disposed in the space when in the inoperative position, and extending from the space when in the operative position.

* * * * *